US007644820B2

(12) United States Patent
Höhne et al.

(10) Patent No.: US 7,644,820 B2
(45) Date of Patent: Jan. 12, 2010

(54) TRANSPORTING CRATE FOR PICTURE FRAMES

(75) Inventors: Uwe Höhne, Köln (DE); Udo Pütz, Köln (DE); Michael Bissot, Köln (DE)

(73) Assignee: Hasenkamp Internationale Transporte GmbH (DE)

( * ) Notice: Subject to any disclaimer, the term of this patent is extended or adjusted under 35 U.S.C. 154(b) by 372 days.

(21) Appl. No.: 11/491,679

(22) Filed: Jul. 24, 2006

(65) Prior Publication Data

US 2007/0023397 A1 Feb. 1, 2007

(30) Foreign Application Priority Data

Jul. 26, 2005 (DE) ..... 20 2005 011 897 U

(51) Int. Cl.
*B65D 81/02* (2006.01)
*B65D 85/00* (2006.01)
*B65D 85/48* (2006.01)

(52) U.S. Cl. ..... 206/523; 206/449

(58) Field of Classification Search ..... 206/523, 206/586, 449, 453, 454, 325, 326, 587, 521.2, 206/521.3, 591, 592, 594
See application file for complete search history.

(56) References Cited

U.S. PATENT DOCUMENTS 3,302,782 A * 2/1967 Pezely, Jr. ..... 206/453
3,410,474 A * 11/1968 Keil ..... 206/586
3,701,465 A * 10/1972 Richter ..... 206/521
3,939,978 A * 2/1976 Thomaswick ..... 206/454
4,162,729 A * 7/1979 Kaiser et al. ..... 206/592
4,892,193 A * 1/1990 Thomas ..... 206/453
4,899,888 A * 2/1990 Shawler ..... 206/586
5,314,159 A 5/1994 Szarata
5,518,118 A 5/1996 Putz et al.
5,595,301 A 1/1997 Putz et al.
6,840,372 B2 * 1/2005 Giles et al. ..... 206/216
7,140,508 B2 * 11/2006 Kuhn et al. ..... 220/592.26
2005/0092645 A1 5/2005 Arnold
2006/0144752 A1 * 7/2006 Forsyth ..... 206/710

FOREIGN PATENT DOCUMENTS

DE 296 06 398 U1 6/1996
DE 100 59 037 5/2002
EP 0569 607 A 11/1993

OTHER PUBLICATIONS

Art in Transit (Handbook for Packing and Transporting Paintings), Copyright 1991, National Gallery of Art, Washington D.C. 20565.

* cited by examiner

*Primary Examiner*—Stephen Garbe
*Assistant Examiner*—Dene Quest
(74) *Attorney, Agent, or Firm*—Andrus, Sceales, Starke & Sawall, LLP

(57) ABSTRACT

In the case of the picture-frame transporting crate according to the invention, a spacing which remains in the height direction between the closed cover (4) and the top side of a picture frame (7) which has been placed in position, or of a padding plate which covers the top side of the picture frame, is filled by means of a heightwise spacer (8) which is coordinated precisely, in terms of length, with this spacing. For this purpose, either a heightwise spacer (8) of appropriate length is selected from a supply or the appropriate heightwise spacer (8) is produced on site by virtue of the appropriate length being cut off precisely from a longer strip or a longer rod.

14 Claims, 9 Drawing Sheets

TRANSPORTING CRATE FOR PICTURE FRAMES

CROSS-REFERENCE TO RELATED APPLICATION

This application claims priority to German Application No. 20 2005 011 897.4, filed Jul. 26, 2005.

FIELD OF THE INVENTION

The invention relates to a transporting crate for picture frames. The teaching of the present invention is explained hereinbelow with reference to the preferred application area for picture frames. It should always be kept in mind, however, that the teaching of the invention can also be applied to other corresponding sheet-like objets d'art such as wooden panels, altarpieces or reliefs, but also for frameless pictures, if these are underpinned by additional supporting plates or panels.

The teaching of the present invention also concerns a method of positioning and fixing a picture frame in a transporting crate of the type in question.

BACKGROUND OF THE INVENTION

Transporting crates are usually used for transporting pictures in picture frames. These crates are usually produced from wood and contain the picture in the frame in the state in which it is positioned in soft padding material, in particular in foamed plastic material. Such a transporting crate is then usually transported in an upright position. The picture is tightly encased on all sides by padding material in order that it does not become damaged if subjected to any vibration or jolting during transportation. Transportation damage occurs again and again along the bottom periphery of the frame, which is subjected to the full weight of the picture and frame. Tightly packed padding all round a picture, moreover, has disadvantages in respect of constant climatic conditions.

Over the years, a fair number of museums have devised certain regulations for transporting their picture frames. The documentation "ART IN TRANSIT" provided by the National Gallery of Art, Washington, in 1991 constitutes relevant prior art in this respect. Section 8 "Packing Cases" describes a "SAMPLE PACKING CASE NO. 4" which has proven successful in practice. The teaching of the present invention is based on this transporting crate.

The prior-art transporting crate for picture frames which has been mentioned above has, in the first instance, a base which defines a length direction and a width direction and is in the form of a plywood panel or laminated-wood panel and, glued to it, four side walls which define a height direction and are likewise made of plywood or laminated-wood panel. The open side of this wooden transporting crate can be closed by a cover which likewise consists of wood. All the surfaces may be stiffened further by reinforcing struts.

All the inner surfaces of the base, side walls and cover of this transporting crate are provided with a continuous layer which is made of a dense closed-cell foamed plastic and, in this case, is approximately 5 cm thick. This continuous layer serves the purposes of thermal insulation and of insulating the interior of this transporting crate. The layer of insulating material on the cover leaves free a narrow periphery all the way round which corresponds to the thickness of the side walls together with the insulating layer there, so that, when the cover is closed, the layer of insulating material is, at it were, fitted in and the periphery of the cover butts directly against the insulating material on the side walls.

The picture frame is actually secured in this transporting crate by additional frame-fastening elements which, in the prior art example described here, this example moreover being depicted hereinbelow in FIG. 7 of the drawing, are in the form of corner angles in all four corners. Each corner angle comprises an additional base leg, which is fastened on the layer of insulating material and is made of a closed-cell, foamed plastic material with good padding properties, in particular a polyethylene foam with a thickness of, in the example, 5 cm to 10 cm, as well as a peripheral crosspiece made of the same material on each adjacent side wall. The fourth part of the respective frame-fastening element, namely a covering leg comprising a corresponding plate, is located in the correct position at the corresponding location, in all four corners on the underside of the cover. If the cover is put in place on the side walls, then the four covering legs complete the other parts of the frame-fastening elements and leave free, in the height direction, a certain spacing between the base leg and the covering leg.

Such a transporting crate can only be used with a picture frame of which the thickness is equal to, or somewhat greater than, the clear spacing in the height direction which is defined by the base legs and the covering legs. The picture frame is always subjected to a certain amount of pressure if it is to be fixed securely in the transporting crate.

A further disadvantage of the transporting crate explained above is that, in terms of all its dimensions, it is suitable basically just for a quite specific picture frame. There is no serious possibility of altering it either in the length direction and width direction or, in particular, in the height direction, that is to say for the thickness of the picture frame.

One advantage of the prior-art transporting crate for picture frames which has been explained above, and on which the present invention is based, resides in its low weight. The consistent use of lightweight, foamed plastic material means that this crate weighs relatively little. This is extremely important, in particular, for transportation of the crate as air freight.

The disadvantages which have been explained above in respect of the transporting crate not being suitable for picture frames of different dimensions have already been recognized in the prior art. In a series of development steps, the applicant of the present application has developed variable transporting-crate systems which allow adjustability in all directions (U.S. Pat. No. 5,314,159; U.S. Pat. No. 5,518,118; U.S. Pat. No. 5,595,301). These transporting crates, however, require a stable metal structure at least for adjustment in the height direction so that, in comparison with the transporting crate which has been explained above, the weight of this universally useable transporting crate is increased.

Irrespective of this, in respect of the various adjustment possibilities which can be gathered from the prior art, reference is made to the abovementioned US publications, the disclosure content of which is also incorporated by reference in the disclosure of the present application.

Taking as departure point the lightweight transporting crate for picture frames which has been explained in the introduction, the teaching of the invention is based on the problem of making it possible for this transporting crate to be used to better effect for picture frames of different dimensions, in particular of different thicknesses.

The transporting crate for picture frames which addresses the above problem is distinguished by the following features:

A transporting crate for picture frames, having a base which defines a length direction and a width direction, having a plurality of side walls which define a height direction, having a cover and having frame-fastening elements which are configured as corner angles or side angles, it being the case that each frame-fastening element consists entirely of lightweight, padding, foamed plastic material or is provided with such a material on the surfaces which come into contact with the picture frame, it being the case that a spacing which remains in the height direction between the closed cover and the top side of a picture frame which has been placed in position, or a padding plate which covers the top side of the picture frame, is, or can be, filled by means of a heightwise spacer of the frame-fastening element, and it being the case that the heightwise spacer is coordinated precisely, in terms of length, with the remaining spacing.

SUMMARY OF THE INVENTION

Preferred configurations and developments form the subject matter of the subclaims.

According to the invention the heightwise spacer, referred to as "covering leg" in the description of the prior art, is coordinated precisely, in terms of length, with the spacing which remains in the height direction between the closed cover and the top side of the picture frame provided, or of a padding plate which covers this top side. It is thus possible for the picture frame provided to be transported in the transporting crate in a precise manner and, in practice, without being subjected to any pressure. Rather than already being included in the transporting crate with certain dimensioning in the height direction, the heightwise spacer is thus adapted in terms of length to the specific picture frame.

The abovementioned task, which is relevant according to the invention, of adapting the length of the heightwise spacer to the specific picture frame in each case can be performed in that a transporting crate is accompanied by a supply of heightwise spacers of different lengths, and the task of coordinating the length of the heightwise spacer appropriate for a picture frame of a certain thickness is performed by a selection being made from the supply of heightwise spacers.

A different solution is provided, however, according to preferred teaching of the invention, namely it is provided that the heightwise spacer consists of a material which is easy to cut on site, in particular of a foamed plastic material, it is initially provided in the form of a longer rod or strip of the material with the cross section of the heightwise spacer, and the task of coordinating the length of the heightwise spacer appropriate for a picture frame of a certain thickness is performed by virtue of the appropriate length being cut off precisely from the rod or the strip.

The solution which is preferred according to the invention for adapting the length of the actual heightwise spacer to the thickness of the picture frame which has been placed in position is based on the fact that the "supply" of heightwise spacers is provided in the form of a continuous, longer rod or strip, possibly also wound up in roll form, made of lightweight, padding, foamed plastic material or some other material which is particularly easy to cut. For example, using a rod made of balsawood would also advantageously be possible in principle. The essential factor is for the material to be one which is easy to cut, using straightforward means, on site.

The transporting crate which is proposed according to the invention makes it possible for the specific picture frame to be positioned in the frame-fastening elements and then for the heightwise spacers for the individual frame-fastening elements to be cut to the length appropriate for the spacing which remains in the height direction up to the inside of the closed cover.

Depending on the nature and surface type of the specific picture frame, it is possible for the latter to be fixed in the height direction in the transporting crate directly by the end side of the respective heightwise spacer or for a padding plate, which covers the top side of the picture frame or a part thereof and is preferably likewise made of foamed plastic material, to be positioned therebetween.

The frame-fastening elements may, in principle, be corner angles or side angles, as has been described specifically in terms of functioning, albeit with a different design, in U.S. Pat. No. 5,518,118.

It is possible, according to the invention, despite the consistent use of lightweight plastic material, to achieve universal adjustability in the height direction for the transporting crate according to the invention.

The possibilities given in the prior art, which has already been mentioned a number of times above, are recommended in respect of adjustability of the frame-fastening elements in the length direction and/or the width direction relative to the base of the transporting crate. These possibilities include not just rail-like transverse adjustment guides and/or longitudinal adjustment guides (U.S. Pat. Nos. 5,518,118 and 5,595,301), but, in particular, also touch-and-close fastening arrangements. For example, it is quite possible to conceive of covering the sheet-like insulating material on the base of the transporting crate with a covering layer of touch-and-close material, on which the frame-fastening elements, which are likewise provided with touch-and-close material on the underside of the base legs, or in any case some of the frame-fastening elements can then be arranged, and fixed at any desired location. A grid panel with discrete adjustment positions in the length direction and width direction would also be a possible variant which could be used here.

According to further-significant teaching of the invention which is also important in its own right, it is also possible to realize the principle of arranging the heightwise spacers according to the teaching of the present invention in the case of lateral spacers. The guides which are necessary in the length direction and width direction can thus be replaced by lightweight spacers made of a foamed plastic material The problem is addressed here by a transporting crate having the following features:

A transporting crate for picture frames, having a base which defines a length direction and a width direction, having a plurality of side walls which define a height direction, having a cover and having frame-fastening elements which are configured as corner angles or side angles, it being the case that each frame-fastening element consists entirely of lightweight, padding, foamed plastic material or is provided with such a material on the surfaces which come into contact with the picture frame, it being the case that a spacing which remains in the height direction between the closed cover and the top side of a picture frame which has been placed in position, or a padding plate which covers the top side of the picture frame, is, or can be, filled by means of a heightwise spacer, and it being the case that at least one frame-fastening element has at least one peripheral crosspiece extending in the height direction, in the case of which a lateral spacer can be fastened in a releasable manner on the outside, which is directed away from the heightwise spacer.

Finally, the teaching concerns particularly expedient methods of positioning and fixing a picture frame in a transporting crate of the type in question.

A first preferred method is defined by the following features:

A method of arranging a picture frame in a transporting crate, it being the case that the transporting crate has a base which defines a length direction and a width direction, a plurality of side walls which define a height direction, a cover and frame-fastening elements which are configured as corner angles or side angles, it being the case that each frame-fastening element of the transporting crate consists entirely of lightweight, padding, foamed plastic material or is provided with such a material on the surfaces which come into contact with the picture frame, it being the case that at least one frame-fastening element has a peripheral crosspiece extending in the height direction, and heightwise female or male shaping of a form-fitting arrangement is provided on the peripheral crosspiece, it being the case that the picture frame is positioned appropriately in the open transporting crate, it being the case that a relatively long rod or a relatively long strip of a material which is easy to cut on site and has a cross section which matches the form-fitting arrangement on the peripheral crosspiece is provided, it being the case that the rod or the strip is plugged in the height direction, by way of a male or female shaping which complements the female or male shaping of the form-fitting arrangement on the peripheral crosspiece into the complementary shaping of the form-fitting arrangement on the peripheral crosspiece until the bottom end of the rod or of the strip rests lightly on the picture frame, it being the case that, with slight pressure being exerted on the surface of the picture frame, the relatively long rod or the relatively long strip is secured and cut off cleanly on the top side of the peripheral crosspiece of the frame-fastening element, and it being the case that the remainder of the relatively long rod or of the relatively long strip is put aside, it being the case that this procedure is carried out for a plurality of, preferably for all, peripheral crosspieces with form-fitting arrangements, and it being the case that, finally, the transporting crate is closed by virtue of the cover being put in place.

A further method, which is also expedient is different from the first, and is defined by the following features:

A method of arranging a picture frame in a transporting crate, it being the case that the transporting crate has a base which defines a length direction and a width direction, a plurality of side walls which define a height direction, a cover and frame-fastening elements which are configured as corner angles or side angles, it being the case that each frame-fastening element of the transporting crate consists entirely of lightweight, padding, foamed plastic material or is provided with such a material on the surfaces which come into contact with the picture frame, it being the case that at least one frame-fastening element has a peripheral crosspiece extending in the height direction, and heightwise female or male shaping of the form-fitting arrangement is provided on the peripheral crosspiece, it being the case that the picture frame is positioned appropriately in the open transporting crate, it being the case that a supply of heightwise spacers of different lengths is kept in stock, these heightwise spacers each having a cross section which matches the form-fitting arrangement on the peripheral crosspiece, it being the case that, for a peripheral crosspiece with a corresponding form-fitting arrangement, a heightwise spacer of appropriate length is selected from the supply of heightwise spacers and is plugged in the height direction, by way of its shaping, into the complementary shaping of the form-fitting arrangement on the peripheral crosspiece until the bottom end rests lightly on the picture frame, it being the case that this procedure is carried out for a plurality of, preferably for all, peripheral crosspieces with form-fitting arrangements, and it being the case that, finally, the transporting crate is closed by virtue of the cover being put in place.

BRIEF DESCRIPTION OF THE DRAWINGS

Overall, preferred configurations and developments and also advantages and variants of the teaching of the invention are described hereinbelow by way of the explanation of exemplary embodiments with reference to the figures of the drawing. In the drawing.

DETAILED DESCRIPTION OF THE PREFERRED EMBODIMENTS

In order to explain the basic construction of a transporting crate for picture frames or the like, reference will be made first of all to FIG. 7, which shows the prior art. Indeed, the basic construction of FIG. 7 also applies to the present transporting crate according to the invention.

Figure 7:
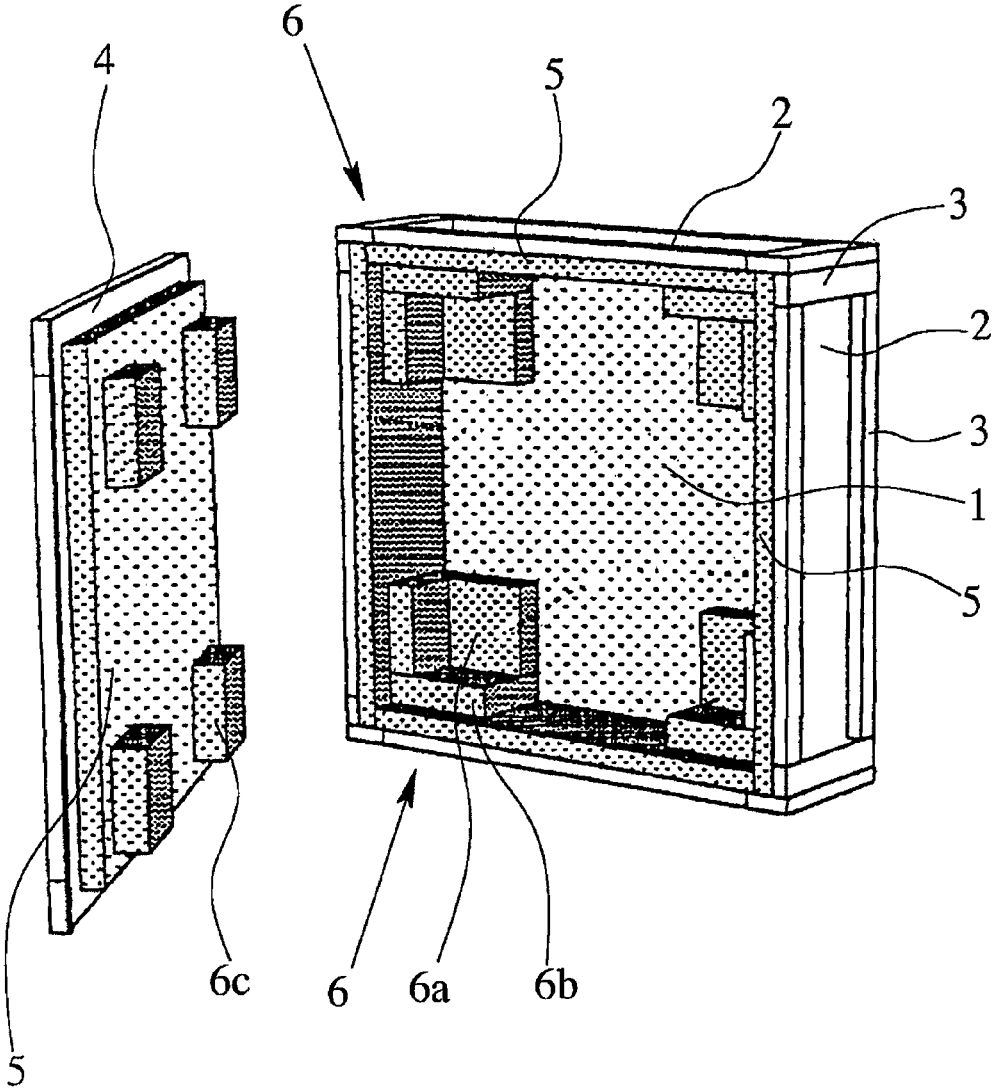
Prior Art Fig. 7
FIG. 7 shows a perspective illustration of a complete transporting crate of the basic construction described here, specifically illustrated in the form of the design belonging to the prior art.

The transporting crate for picture frames or the like which is illustrated in perspective in FIG. 7 has, in the first instance, a base 1 which in this case consists of plywood or laminated wood and defines a length direction and a width direction. Fixed to the base 1 are a plurality of side walls 2 which define a height direction, in this case four side walls 2, which are arranged in a rectangle, and likewise consist of plywood or laminated wood. Additional wooden struts 3 can be seen on the side walls 2. Wood is the most commonly used material for such a transporting crate, although it would, of course, also be possible in principle, to use aluminum or some other metal or a correspondingly injection-molded thermoplastic material. For cost-related reasons, however, wood is used in most cases.

Shown on the left in FIG. 7 is a cover 4, which is likewise configured here as a panel made of plywood or laminated wood.

In the example illustrated here, all the inner surfaces of the transporting crate are provided with a continuous layer made of a plastic insulating material 5. The general part of the description has already referred to the special features of this insulation material 5. It serves for thermal insulation and vibration insulation, but not, in this case, for padding purposes. A typical insulating material is formed by a foamed polystyrene.

The transporting crate which is illustrated in FIG. 7, and is attributable to the prior art, has, in the exemplary embodiment illustrated, a wooden-panel thickness of 12 mm to 19 mm, with corresponding struts, and an insulating-material layer thickness of approximately 5 cm.

In the exemplary embodiment illustrated in FIG. 7, frame-fastening elements 6 configured as corner angles are located in all four corners. These frame-fastening elements 6 here consist entirely of a lightweight, padding, foamed plastic material in particular of a polyethylene foam. Such a product is commercially available, for example, under the brand name Neopolen E or the brand name EPERAN. The essential factors are its excellent padding properties, its good restoring properties following dynamic loading, its very low level of water absorption and its good chemical resistance.

In the exemplary embodiment illustrated, each frame-fastening element 6 comprises a plate-like base leg 6*a*, a likewise plate-like peripheral crosspiece 6*b* on each of the adjacent side walls 2 and a plate-like covering leg 6*c* which has already been put in position on the cover 4. The special feature of this design is explained in detail in the general part of the description.

It is obvious in the illustration of FIG. 7 that, rather than covering the entire inner surface area of the cover 4, the insulating material 5 of the cover 4 leaves free a periphery all the way round which corresponds approximately to the thickness of the side walls 2. It is thus possible for the cover 4 to be put in place on the side walls 2 and at the same time, for the insulating material 5 on the cover 4 to be allowed to "penetrate" inward, so that it butts against the insulating material 5 of the side walls 2. In specific terms, the insulating material 5 rests on the peripheral crosspieces 6*b* of the frame-fastening elements 6 and is located within the layers of insulating material 5 on the side walls 2.

Figure 1:
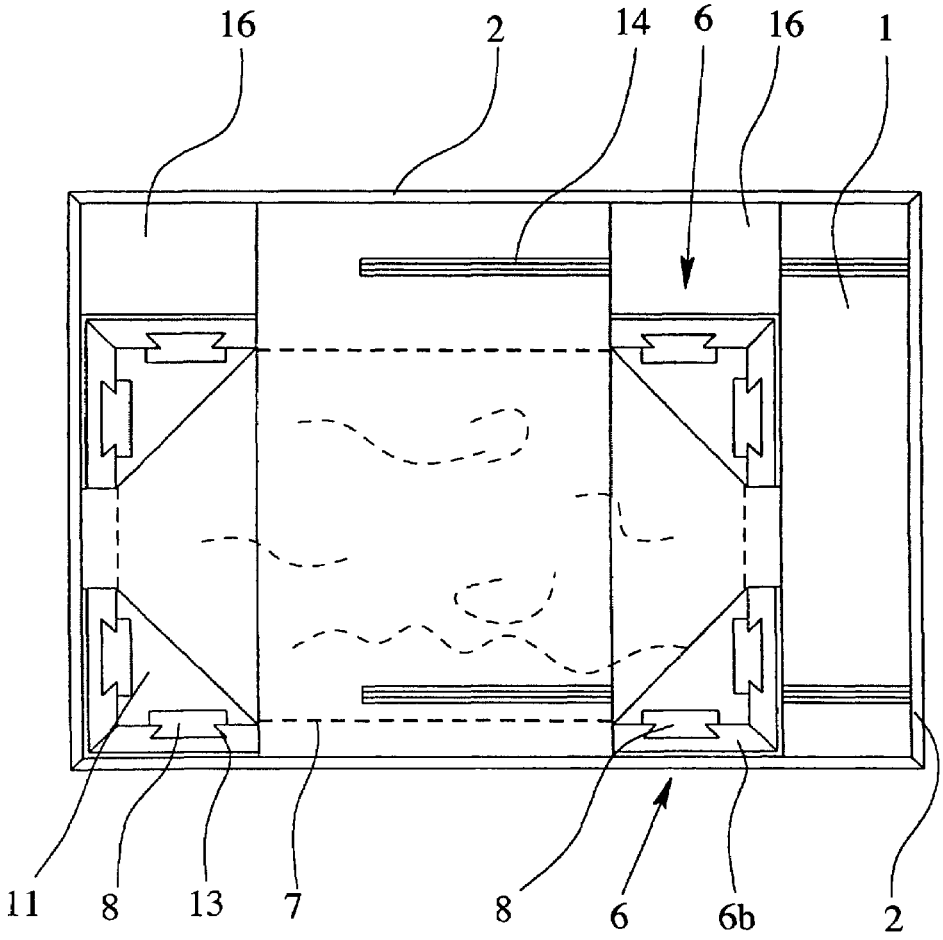
FIG. 1 shows a plan view of a first exemplary embodiment of a transporting crate according to the invention, with the cover removed.
Figure 3:
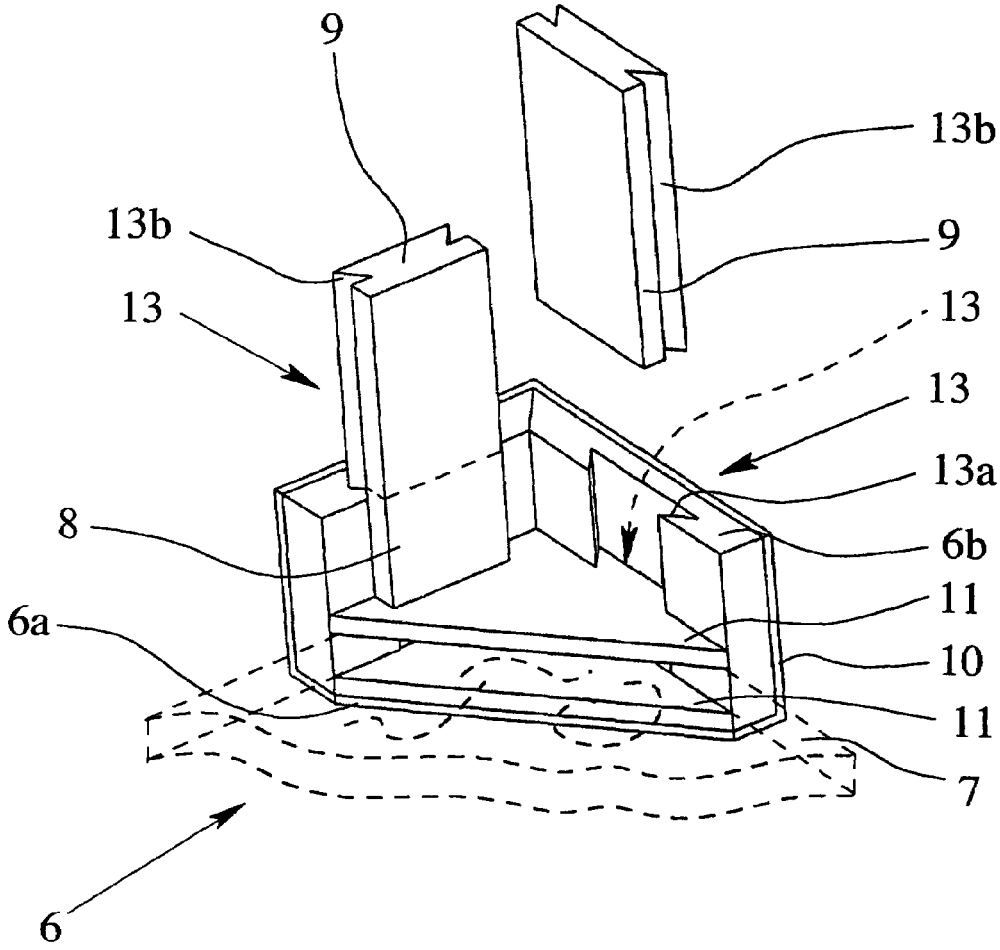
FIG. 3 shows an enlarged, perspective illustration of a frame-fastening element of the exemplary embodiment according to FIG. 1.
Figure 3A:
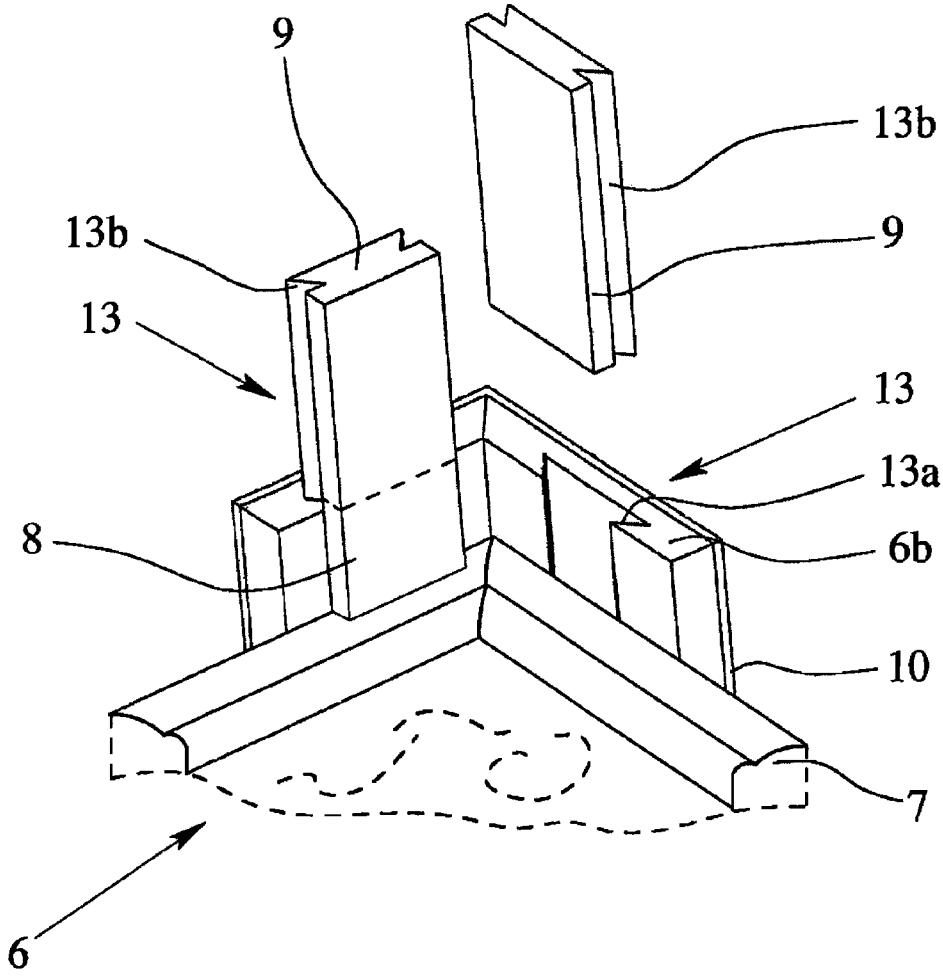
FIG. 3*a* shows an enlarged, perspective illustration of a frame fastening element of another exemplary embodiment.

There is no picture frame 7 indicated in FIG. 7, but such a picture frame 7 is indicated by dashed lines in FIGS. 1 and 3, so that it is possible to conceive of how the picture frame 7 is positioned in such a transporting crate.

FIG. 7 shows that, in any case, what matters is that each frame-fastening element 6 either consists entirely, as is the case in FIG. 7, of lightweight, padding, foamed plastic material or is provided with such a padding material in any case on the surfaces which come into contact with the picture frames 7 or the like.

It can also be seen clearly from FIG. 7 in conjunction with FIG. 1 that it would be conceivable for at least one frame-fastening element 6 to be placed, and fixed, in different positions in the length direction and/or in the width direction relative to the base 1. Touch-and-close fastening arrangements over the entire surface area have already been mentioned here.

A further important factor for fixing the picture frame 7 securely in the transporting crate is the height direction. The covering legs 6*c* in the prior-art exemplary embodiment from FIG. 7 constitute heightwise spacers 8 by means of which a spacing which remains in the height direction between the closed cover 4 and the top side of a picture frame 7 which has been placed in position, or a padding plate which covers the top side of the picture frame, can be, or is, filled.

If one looks at FIGS. 1 and 3 together, then it can be seen that the static, predetermined dimensioning of the prior art according to FIG. 7 has been replaced according to the invention in that the heightwise spacer 8 (referred to as covering leg 6*c* in the prior art from FIG. 7) is coordinated precisely, in terms of length, with the spacing remaining in the height direction, which has been explained above. Oversizing of the heightwise spacer 8 in the height direction is always avoided.

As has already been explained in the general part of the description, the specific teaching can be realized in that a transporting crate is accompanied by a supply of heightwise spacers 8 of different lengths, and the task of coordinating the length of the heightwise spacer 8 appropriate for a picture frame 7 of a certain thickness is performed by a selection being made from the supply of heightwise spacers 8. For this purpose, the abovementioned supply of heightwise spacers 8 of different lengths would then have to be kept in stock.

Figure 4:
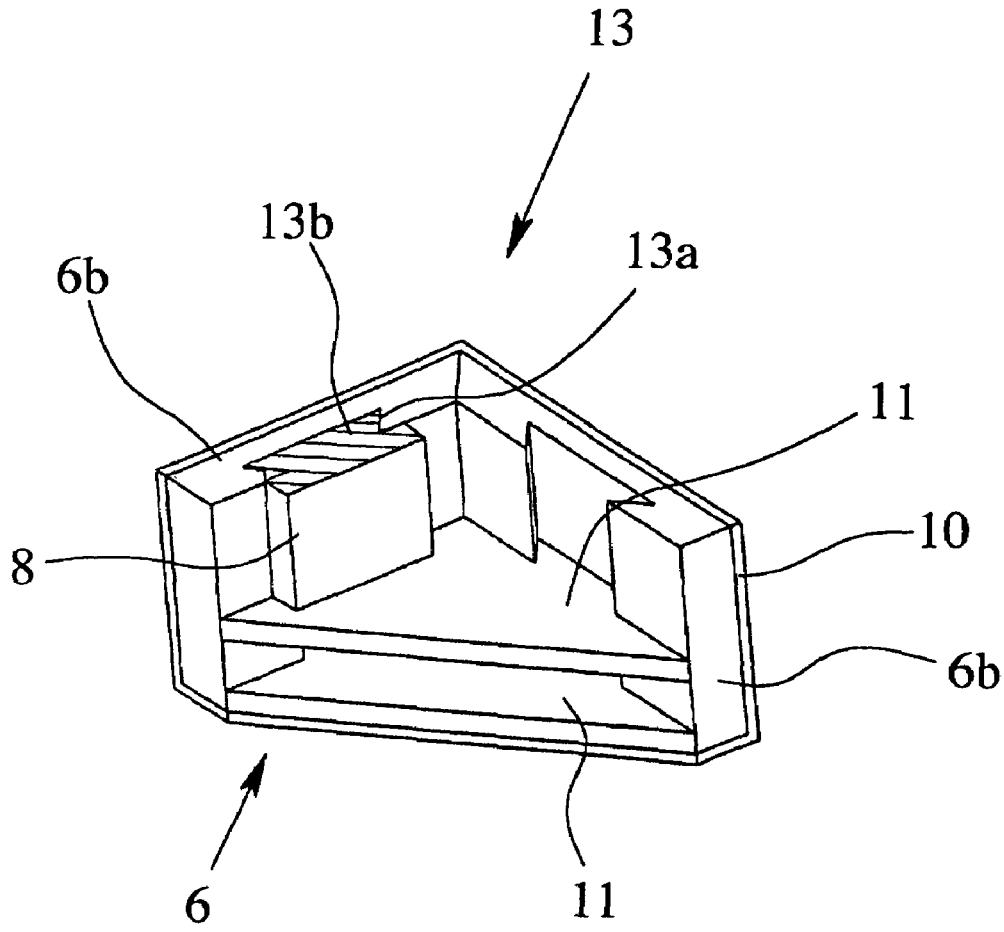
FIG. 4 shows the illustration from FIG. 3, in this case with the already inserted heightwise spacer cut to the desired length.
Figure 4A:
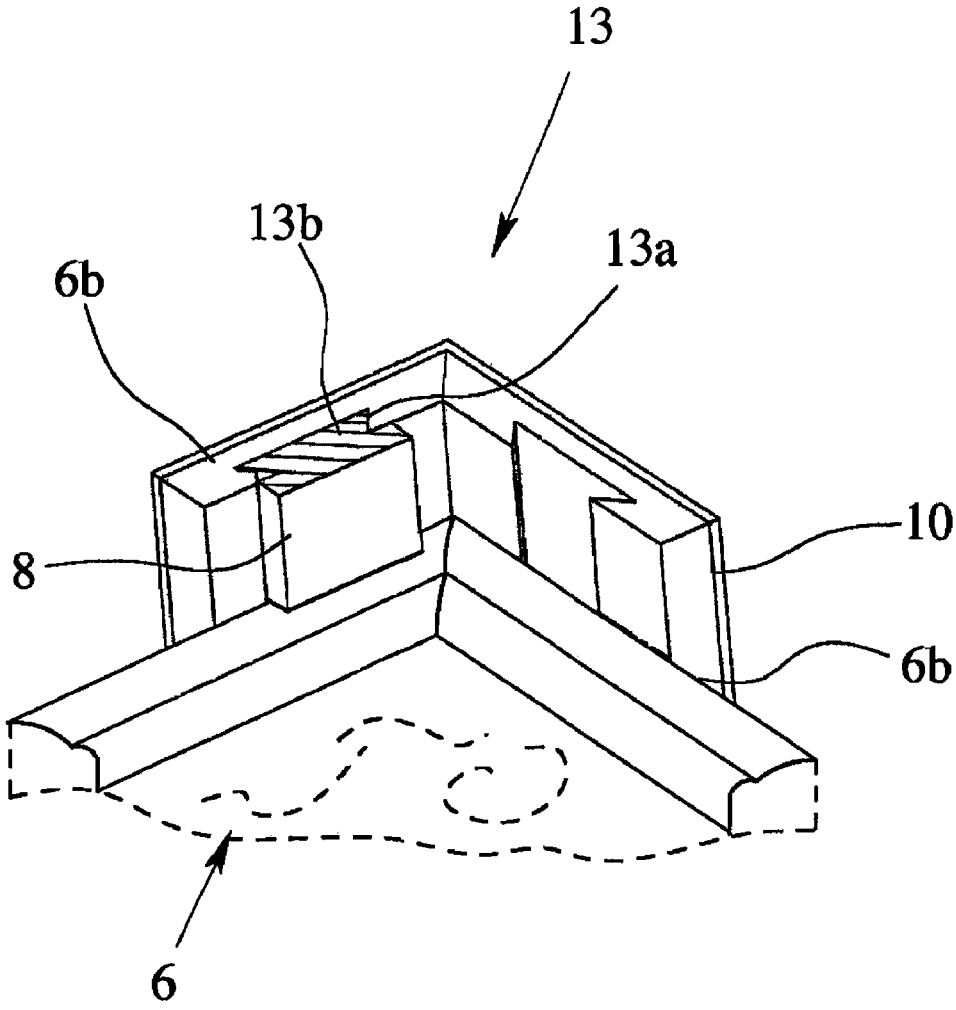
FIG. 4*a* shows the illustration from FIG. 3*a*, in this case with the already inserted heightwise spacer cut to the desired length.

FIGS. 1 and 3 together show that, in accordance with preferred teaching, it is provided here that the heightwise spacer 8 consists of a material which is easy to cut on site, in particular of a foamed plastic material, it is initially provided in the form of a longer rod 9 or strip of the material with the cross section of the heightwise spacer 8, and the task of coordinating the length of the heightwise spacer 8 appropriate for a picture frame 7 of a certain thickness is performed by virtue of the appropriate length being cut off precisely from the rod 9. FIG. 4 shows how the longer rod 9 has been made into the heightwise spacer 8 shortened to the desired length on site.

Since the heightwise spacer 8 or the rod 9 according to the invention is made of material which is easy to cut on site, in particular of foamed plastic material, for example once again of a polyethylene foam, the rod 9 can readily be cut on site so as to fill precisely the spacing which remains in the height direction in respect of the specific picture frame 7.

The specific dimensioning of the heightwise spacer 8 which is proposed in accordance with the preferred teaching, can be achieved by virtue of the remaining spacing in the height direction being measured with the picture frame 7 already placed in position and of this being measured out on the rod 9. Going from FIG. 3 to FIG. 4, however, the exemplary embodiment illustrated shows that, in accordance with preferred teaching, it is provided that the top edge of the frame-fastening element 6 defines the position of the underside of the cover 4, and that the task of cutting off the heightwise spacer 8 of appropriate length from the longer rod 9 is performed directly at the top edge of the frame-fastening element 6, with the rod 9 inserted or plugged into the frame-fastening element 6. This automatically results in the correct height dimension.

If a sufficient number of heightwise spacers 8 or all the heightwise spacers 8, have been plugged in and cut to the necessary length, then the cover 4 can be put in place and the transporting crate can thus be closed. The picture frame 7 is then fixed securely.

As has already been realized in part in the prior art explained in the introduction, it is also possible to provide, within the context of the design according to the invention, for the frame-fastening elements 6 or individual frame-fastening elements 6, to be formed in whole or in part from a continuous padded lining throughout the transporting crate. However, independent complete frame-fastening elements 6 with a base leg 6*a*, peripheral crosspiece 6*b* and heightwise spacer 8 are realized in the exemplary embodiments which are illustrated and preferred.

FIG. 3 shows a design of the frame-fastening element 6 with its basic shape 10 configured as a corner angle and made, for example, of wood or rigid, thermoplastic material and, fitted thereon, the plastic padding material of the base leg 6*a* in the form of a corresponding padding plate and the two peripheral crosspieces 6*b*. FIG. 3 uses dashed lines to illustrate the picture frames 7 placed in position and, thereon, also an angled padding plate 11 which is adapted to the shape of the frame-fastening element 6 and is made of foamed plastic material, in particular, once again, of a polyethylene foam. This padding plate 11 need not always be present, however; it is quite possible, in certain circumstances, for the picture frame 7 to be fixed in the height direction just by the heightwise spacers 8

Figure 5:
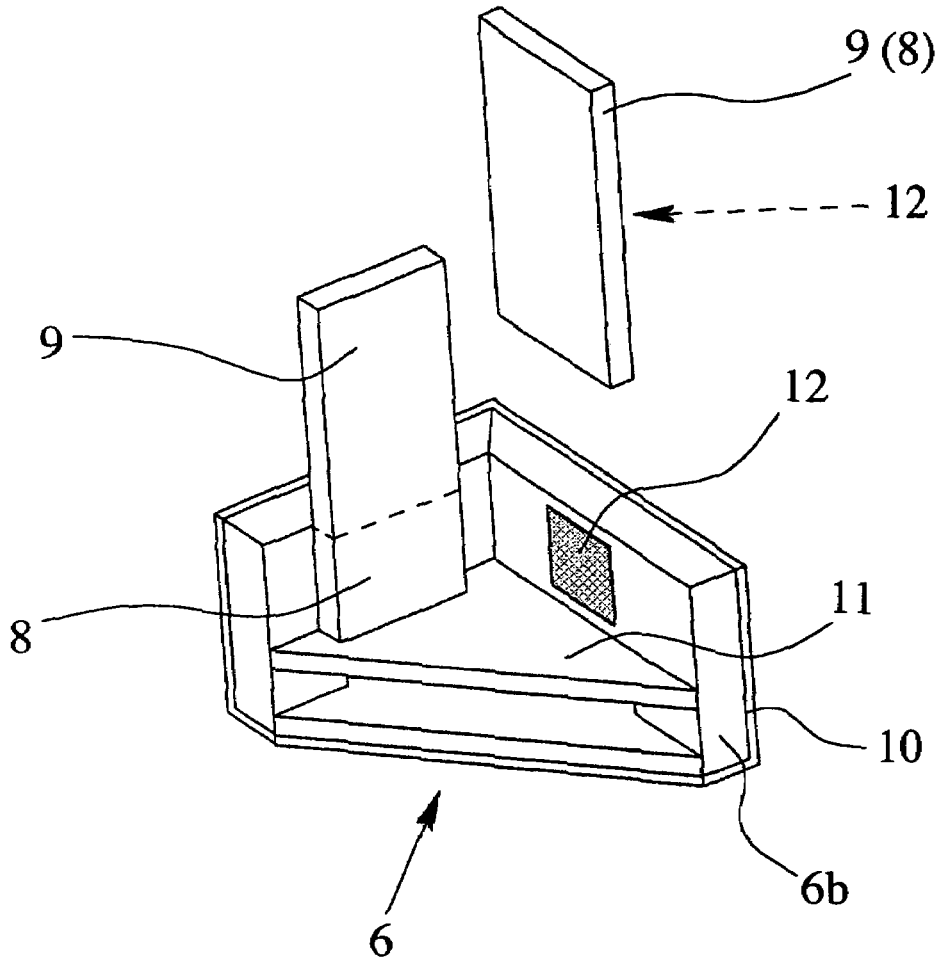
FIG. 5 shows, in an illustration corresponding to FIG. 3, a frame-fastening element with a heightwise spacer which is fastened by a touch-and-close fastening arrangement.

Touch-and-close fastening arrangements 12 can be used in order to fasten the heightwise spacers 8 in a releasable manner on the peripheral crosspieces 6*b* of the frame-fastening elements 6. This is shown in the modified exemplary embodiment of FIG. 5. In the case of the rod 9 on the left in FIG. 5, a dashed line indicates the location at which the heightwise spacer 8 is cut. The heightwise spacers 8 have touch-and-close fastening surfaces on their rear side which match a touch-and-close fastening surface which forms part of the touch-and-close fastening arrangement 12 and is located on the peripheral crosspiece 6*b* of the frame-fastening element 6, these surfaces only being indicated in FIG. 5.

As an alternative to a touch-and-close fastening arrangement 12, it is also possible to provide an adhesive-bonding arrangement, which should preferably be of re-releasable configuration.

It is preferred if a form-fitting arrangement 13 is provided in order to fasten the heightwise spacer 8 in a releasable manner on the peripheral crosspiece 6*b* of the frame-fastening element 6. In the preferred exemplary embodiment illustrated in FIGS. 1, 3, 4 and 6, it is provided that the form-fitting arrangement 13 comprises female shaping running in the height direction and matching male shaping. In the exemplary embodiment illustrated, the female shaping is located on the peripheral crosspiece 6*b*, while the male shaping is located on the heightwise spacer 8. This is particularly expedient because all the space in the angle formed by the frame-fastening element 6 can thus be utilized for the surface of the picture frame 7. The female shaping is formed, for example, by a T groove, although in the exemplary embodiment which is illustrated, and preferred, it is formed by a dovetail groove 13*a*. Correspondingly, the male shaping here is formed by a dovetail tongue 13*b* on the heightwise spacer 8.

As can be seen from FIG. 3, the rod 9, which contains the heightwise spacer 8 in the form of a cut-off part, is plugged into the dovetail groove 13*a* on the peripheral crosspiece 6*b* from above, by means of the dovetail tongue 13*b*, until the end side of the rod 9 is seated on the top padding plate 11. The rod 9 is then cut off flush with the top periphery of the peripheral crosspiece 6*b*, and the desired spacing in the height direction is automatically realized by means of the heightwise spacer 8, see FIG. 4.

Figure 2:
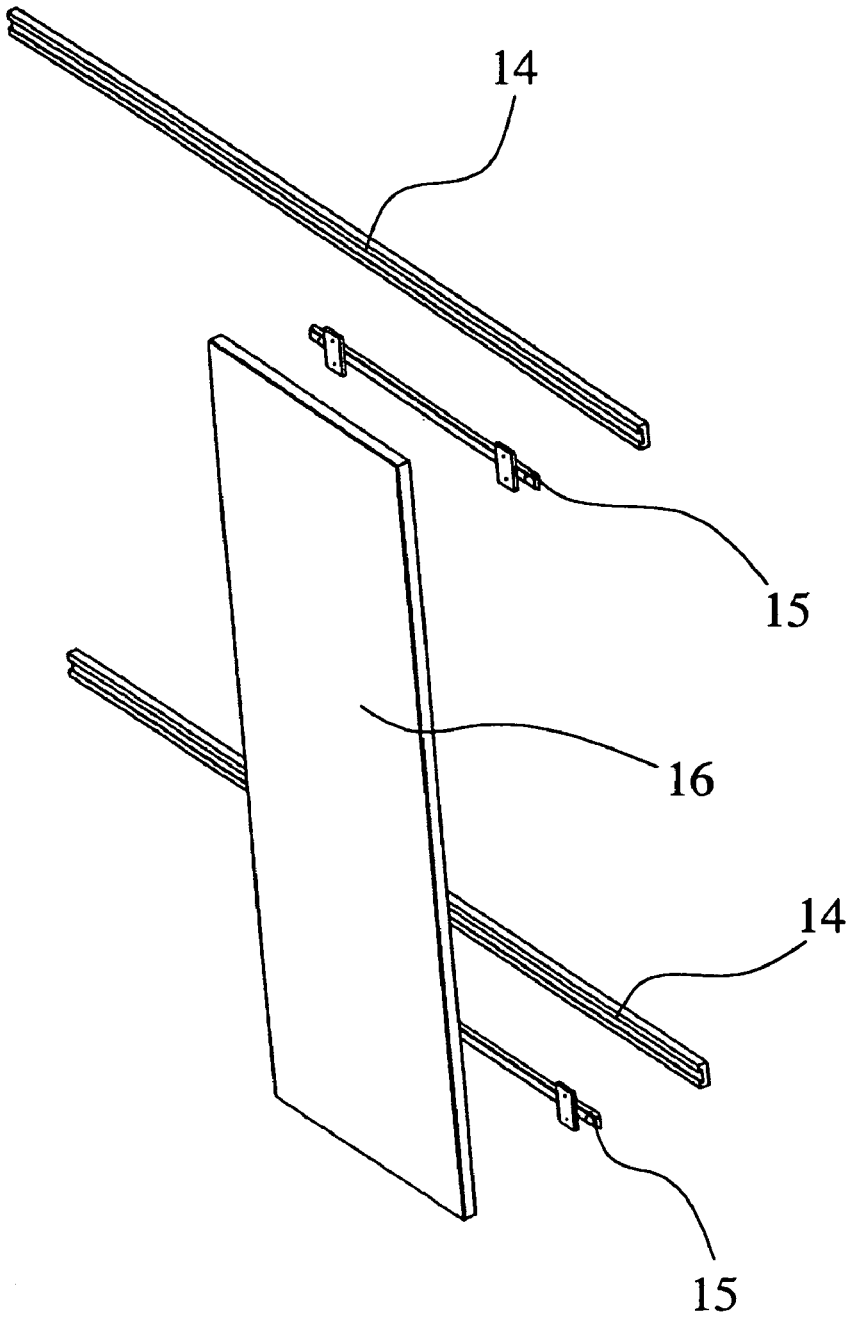
FIG. 2 shows a system for displacing the frame-fastening elements of the transporting crate from FIG. 1.

It can also be seen in FIG. 2, in conjunction with FIG. 1, how, in the first exemplary embodiment, all the right-hand, frame-fastening elements 6 are adjusted in the length direction in relation to the left-hand frame-fastening elements 6. Provided for this purpose are guide rails 14 which are known per se from the prior art and in which guide strips 15 on the underside of a touch-and-close fastening panel 16 can slide. It is thus possible to displace the entire touch-and-close fastening panel 16 with the two frame-fastening elements 6 in FIG. 1, while the touch-and-close fastening panel 16 on the left in FIG. 1 is fixed in position. Touch-and-close fastening arrangements on the touch-and-close fastening panel 16, however, can be used to shift the respective frame-fastening elements 6 individually, in turn, in the width direction.

It can also be seen from FIG. 3 that a form-fitting arrangement 13 is also provided in order to fasten the padding plate 11 in a releasable manner on the frame-fastening element 6. In the exemplary embodiment which is illustrated, and to this extent preferred, it is specifically provided that the part or the parts of the form-fitting arrangement 13 on the frame-fastening element 6 is or are the same both for the heightwise spacer 8 and for the padding plate 11.

Particularly elegant lengthwise and widthwise adjustability which can be executed, in turn, with low weight, can be achieved, according to further teaching of the invention, in that the frame-fastening element 6 has at least one peripheral crosspiece 6*b* extending in the height direction, and in that a lateral spacer 17 can be fastened in a releasable manner on the outside of the peripheral crosspiece 6*b* which is directed away from the heightwise spacer 8. It is provided here that the spacer 17 consists of a lightweight material, in particular of a foamed plastic material (FIG. 6).

Basically the same considerations as for the heightwise spacer 8 apply to the task of fitting the spacer 17 or the spacers 17. FIG. 6 shows a form-fitting arrangement 19 in this respect.

Figure 6:
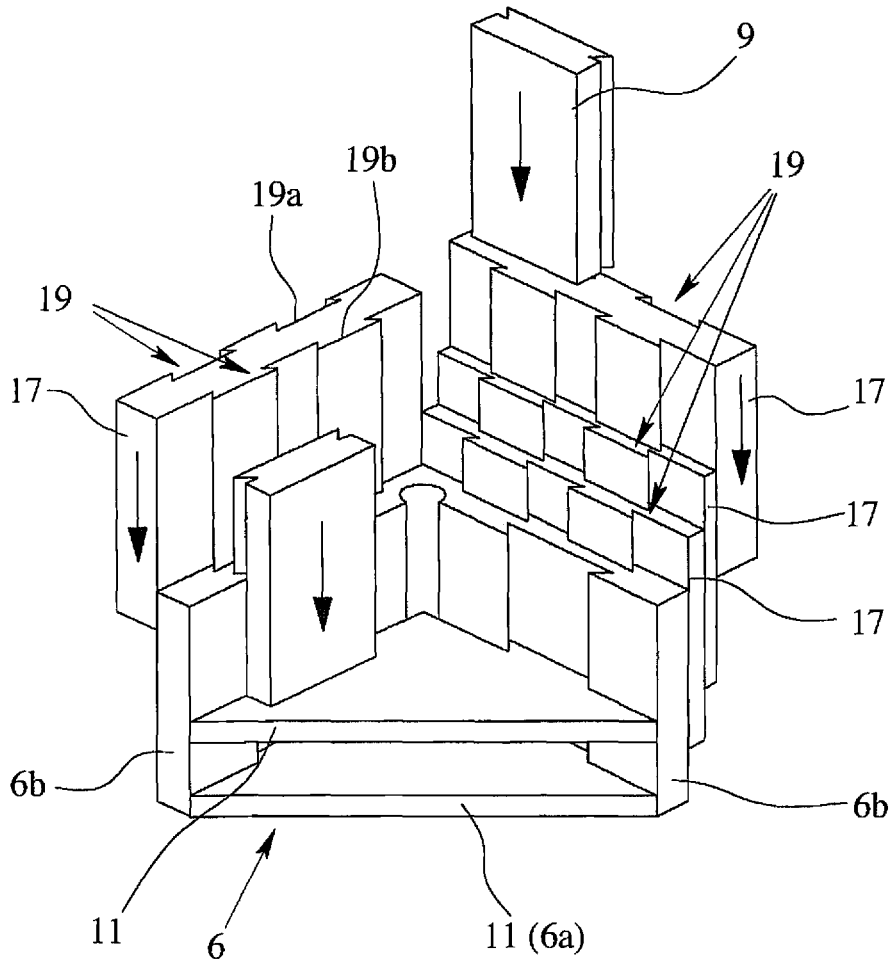
FIG. 6 shows, in an illustration corresponding to FIG. 3, a frame-fastening element with spacers which are provided with form-fitting arrangements.

FIG. 6 also shows a particularly preferred configuration of the transporting crate according to the invention where the frame-fastening element 6 actually consists entirely of foamed plastic material, in particular polyethylene foam, and where it is also provided that each spacer 17, for its part, has female shaping on one side, and on the opposite side, matching male shaping of a form-fitting arrangement 19. In specific terms, the peripheral crosspiece 6*b* of this frame-fastening element 6 has the dovetail groove 13*a* for the heightwise spacer 8 and, opposite this, a further dovetail groove 19*a* for the associated spacer 17. The spacer 17 itself has a dovetail tongue 19*b* on one side and, opposite this, a dovetail groove 19*a* for the connection, if necessary, of a further spacer 17. A limited number of spacers 17 of different thicknesses, for example 15 mm, 20 mm, 30 mm, 100 mm, makes it possible to realize virtually all the necessary lengthwise and widthwise adjustments for the frame-fastening elements 6 of this transporting crate.

The exemplary embodiment which is illustrated in FIG. 6 shows, on the left, a thick spacer 17 and, on the right, a thick spacer 17, a thin spacer 17 and a medium-sized spacer 17. The arrangement of the dovetail grooves 19*a* and dovetail tongues 19*b* for the spacers 17 results in the frame-fastening element 6 not having any projecting dovetail tongues 19*b* on the outer sides. It can thus always be inserted smoothly into the transporting crate. The same applies to other shapings of form-fitting arrangements 19.

Moreover, it is also the case that the spacers 17 can be fixed by touch-and-close fastening arrangements or adhesive bonding arrangements in relation to the frame-fastening element.

The frame-fastening element 6 is typically 15 cm to approximately 25 cm, in the height direction, while the padding plates 11 have a typical thickness of 20 mm.

The invention claimed is:

1. A transporting crate for transporting at least one picture frame, the transport crate comprising:

a base extending in a length direction and a width direction;

a plurality of side walls coupled to the base and extending in a height direction;

a cover selectively positionable in a closed position to close the transporting crate and an open position to open the transporting crate;

a plurality of frame-fastening elements configured as corner angles or side angles, each frame-fastening element having at least one peripheral crosspiece extending in the height direction;

wherein surfaces of the plurality of frame-fastening elements that will come into contact with a picture frame disposed in the transporting crate comprise lightweight, padding, foamed plastic material;

wherein the peripheral crosspiece is configured to releasably couple with a heightwise spacer so that the spacer fills a space remaining in the height direction between the cover in the closed position and a top side of a picture frame disposed in the transport crate or a padding plate which covers the top side of a picture frame disposed in the transport crate; and a plurality of heightwise spacers of different lengths, each spacer configured to be selectively, releasably coupled to the peripheral crosspiece so as to extend in the height direction and fill said space;

wherein selection of different spacers from the plurality fills said space when picture frames having different thicknesses are transported.

2. The transporting crate according to claim 1, wherein at least one heightwise spacer in the plurality consists of a foamed plastic material.

3. The transporting crate according to claim 1, wherein the crosspiece and spacers are releasably coupled by a form-fitting arrangement.

4. The transporting crate according to claim 1, wherein the frame-fastening elements comprise padding plates that are made of padding material and that can be disposed above or below a picture frame in the transporting crate.

5. The transporting crate according to claim 4, comprising a form-fitting arrangement configured to couple each padding plate in a releasable manner to a respective frame-fastening element.

6. The transporting crate according to claim 5, wherein the form-fitting arrangement is further configured to couple the heightwise spacer in a releasable manner to the peripheral crosspiece.

7. A transporting crate for transporting at least one picture frame, the transport crate comprising:

a base extending in a length direction and a width direction;

a plurality of side walls coupled to the base and extending in a height direction;

a cover selectively positionable in a closed position to close the transporting crate and an open position to open the transporting crate;

a plurality of frame-fastening elements configured as corner angles or side angles, each frame-fastening element having at least one peripheral crosspiece extending in the height direction;

wherein surfaces of the plurality of frame-fastening elements that will come into contact with a picture frame disposed in the transporting crate comprise lightweight, padding, foamed plastic material;

wherein the peripheral crosspiece is configured to releasably couple with a heightwise spacer so that the spacer fills a space remaining in the height direction between the cover in the closed position and a top side of a picture frame disposed in the transport crate or a padding plate which covers the top side of the picture frame; and a rod or strip of material that is mateable with the peripheral cross piece in the height direction and that is cuttable at the top edge of the frame fastening element when the rod or strip of material is mated with the frame-fastening element such that a lower end of the rod or strip of material abuts a picture frame disposed in the transporting crate, wherein cutting of the rod or strip of material thereby forms said heightwise spacer having a length appropriate to fill said space when a picture frame of a certain thickness is disposed in the crate;

wherein the top edge of the frame-fastening element defines the position of the underside of the cover.

8. The transporting crate according to claim 7, wherein the heightwise spacer consists of a foamed plastic material.

9. The transporting crate according to claim 7, comprising a form-fitting arrangement configured to fasten the heightwise spacer in a releasable manner on the peripheral crosspiece.

10. The transporting crate according to claim 7, wherein the frame-fastening elements comprise padding plates that are made of padding material and that can be disposed above or below a picture frame in the transporting crate.

11. The transporting crate according to claim 10, comprising a form-fitting arrangement configured to fasten the padding plate in a releasable manner on the respective frame-fastening element.

12. The transporting crate according to claim 11, wherein the form-fitting arrangement is further configured to couple the heightwise spacer in a releasable manner to the peripheral crosspiece.

13. A method of arranging a picture frame in a transporting crate, (a) providing a transporting crate having a base that extends in a length direction and a width direction, a plurality of side walls that extend in a height direction, a cover that is positionable in an open position to open the transport crate and a closed position to close the transport crate, and a plurality of frame-fastening elements that form corner angles or side angles; wherein surfaces of the plurality of frame-fastening elements that will come into contact with a picture frame disposed in the transporting crate comprise lightweight, padding, foamed plastic material; and wherein at least one frame-fastening element has a peripheral crosspiece extending in the height direction, the peripheral crosspiece forming one part of a male-female form-fitting arrangement and having a top side;

(b) positioning a picture frame in the transporting crate when the cover is in the open position;

(c) providing a relatively long rod or strip of a material having top and bottom ends, the rod or strip of material being easy to cut and having a cross section that forms the other part of the male-female form-fitting arrangement;

(d) coupling the rod or the strip of material to the peripheral crosspiece via the male-female form-fitting arrangement and so that the bottom end of the rod or of the strip of material abuts the picture frame;

(e) constructing a heightwise spacer that fills a space remaining in the height direction between the cover in the closed position and a top side of a picture frame disposed in the transport crate or a padding plate which covers the top side of a picture frame disposed in the transport crate by cutting the top end of the rod or strip of material away from the bottom end of the rod or strip of material at a location flush with the top side of the peripheral crosspiece;

(f) repeating steps (c) through (e) to construct a plurality of heightwise spacers that each fill the space remaining in the height direction between the cover in the closed position and the top side of a picture frame disposed in the transport crate or a padding plate which covers the top side of a picture frame disposed in the transport crate; and (g) closing the transporting crate by moving the cover into the closed position.

14. A method of arranging a picture frame in a transporting crate, (a) providing a transporting crate having a base that extends in a length direction and a width direction, a plurality of side walls that extend in a height direction, a cover that is positionable in an open position to open the transport crate and a closed position to close the transport crate, and a plurality of frame-fastening elements that form corner angles or side angles; wherein surfaces of the plurality of frame-fastening elements that will come into contact with a picture frame disposed in the transporting crate comprise lightweight, padding, foamed plastic material; wherein at least one frame-fastening element has a peripheral crosspiece extending in the height direction, the peripheral crosspiece having a top side and forming one part of a plurality of male-female form-fitting arrangements;

(b) positioning a picture frame in the transporting crate when the cover is in the open position;

(c) providing a plurality of heightwise spacers of different lengths, each having a cross section which forms the other part of the male-female form-fitting arrangement;

(d) selecting a heightwise spacer from the plurality of heightwise spacers having a length necessary to fill a space remaining in the height direction between the cover in the closed position and the top side of a picture frame disposed in the transport crate or a padding plate which covers the top side of a picture frame disposed in the transport crate;

(e) coupling the selected spacer and the peripheral cross-piece in the height direction and by way of the male-female form-fitting arrangement until the bottom end of the selected spacer abuts a picture frame disposed in the transporting crate;

(f) repeating steps (d) and (e) to couple additional spacers to remaining parts of the male-female form-fining arrangements on the peripheral crosspiece, and (g) closing the transport crate by moving the cover into the closed position.

* * * * *

UNITED STATES PATENT AND TRADEMARK OFFICE

CERTIFICATE OF CORRECTION

PATENT NO. : 7,644,820 B2
APPLICATION NO. : 11/491679
DATED : January 12, 2010
INVENTOR(S) : Höhne et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 544 days.

Signed and Sealed this

Sixteenth Day of November, 2010

David J. Kappos

David J. Kappos
*Director of the United States Patent and Trademark Office*